US006739887B1

(12) United States Patent
Yu

(10) Patent No.: US 6,739,887 B1
(45) Date of Patent: May 25, 2004

(54) SECURITY DEVICE OF POWER RECEPTACLE

(76) Inventor: Tsung-I Yu, No. 209, Sec. 3, County Boulevard, Pan Chiao City, Taipei (TW)

( * ) Notice: Subject to any disclaimer, the term of this patent is extended or adjusted under 35 U.S.C. 154(b) by 0 days.

(21) Appl. No.: 10/611,974

(22) Filed: Jul. 3, 2003

(51) Int. Cl.[7] ..... H01R 13/44
(52) U.S. Cl. ..... 439/137
(58) Field of Search ..... 439/137, 135, 439/145

(56) References Cited

U.S. PATENT DOCUMENTS 4,729,741 A * 3/1988 Peng ..... 439/137
5,391,085 A * 2/1995 Tigner ..... 439/137
5,915,981 A * 6/1999 Mehta ..... 439/137

* cited by examiner

*Primary Examiner*—Tho D. Ta
*Assistant Examiner*—James R. Harvey
(74) *Attorney, Agent, or Firm*—Bacon & Thomas, PLLC

(57) ABSTRACT

A security device for a power receptacle. The device includes a slot cover, a protection cover, and elastic elements. A surface of the slot cover is formed with slots. At least two recesses penetrate into the interior of the receptacle. An inner lateral surface of at least one recess is installed with a positioning block. The protection cover is a sheet body with holes on a surface thereof. At least two hooking sheets are installed at an inner surface of the protection cover. At least one hooking sheet is installed with a fixing block. The hooking sheets of the protection cover can be movably engaged to the recesses of the slot cover. The elastic elements are positioned between the positioning blocks and fixing blocks. The protection cover is movable and restorable due to the elasticity of the elastic elements.

7 Claims, 6 Drawing Sheets

SECURITY DEVICE OF POWER RECEPTACLE

BACKGROUND OF THE INVENTION (a) Field of the Invention

The present invention relates to security devices, and particularly to a security device of a power receptacle applied to slots of a wall receptacle or an extension line receptacle. Normally, the present invention seals the slots of a slot cover for preventing the intrusion of undesired objects. Furthermore, a plug can be pushed into the slot for power conduction.

(b) Description of the Prior Art

Conventionally, the slots of a receptacle are aligned to the conductive sheets in the receptacle. Plugs can be inserted into the receptacle rapidly and conveniently. However, this conventional structure easily induces accidents, namely electric shocks. This is because in general, fixed-type receptacles are placed about one foot away from the ground floor and the plugs of the extension lines are placed on the ground randomly, and it is very possible for children to insert objects, such as screws, nails, or tools, into the slots of the receptacles, so as to induce electric shock. Moreover, since the slots are conductive to the conductive arms or plugs, dust or insects will easily enter into the slots so as to affect the quality of the receptacle, and even the conductive arms will be oxidized. There is an eager demand for novel security devices used in power receptacles which can improve the prior art.

SUMMARY OF THE INVENTION

Accordingly, the primary object of the present invention is to provide a security device of a power receptacle which comprises a slot cover, a protection cover and a plurality of elastic elements. The slot cover is a cover installed on a receptacle. A surface of the slot cover is formed with at least one power slot set. A surface of the power slot set has at least two recesses penetrating to an interior of the receptacle. At least one recess in an inner surface of the slot cover is installed with a positioning block at a lateral side thereof. A protection cover serves for isolating the sheets of slots of the slot cover. A surface thereof is installed with a plurality of holes corresponding to the slots. An inner surface thereof is installed with a plurality of slots corresponding to a plurality of hooking arms corresponding to the recesses of the protection cover. At least one hooking arm is installed with the fixing block at a lateral side thereof. A plurality of elastic elements allow the protection cover to isolate the elements of the slots. Thereby, the hooking arms at the inner surface of the protection cover are inserted into the recesses of the slot cover. The recesses of the slot cover can not be guided to move linearly. The elastic elements are installed between the positioning blocks of the slot cover and the fixing blocks of the hooking sheets. The elastic elements resist against the protection cover. As a result, the protection cover will seal the slots; and moreover, after moving the protection cover, the holes of the protection cover will align to the slots of the slot cover.

The various objects and advantages of the present invention will be more readily understood from the following detailed description when read in conjunction with the appended drawing.

DETAILED DESCRIPTION OF THE PREFERRED EMBODIMENTS

Figure 1:
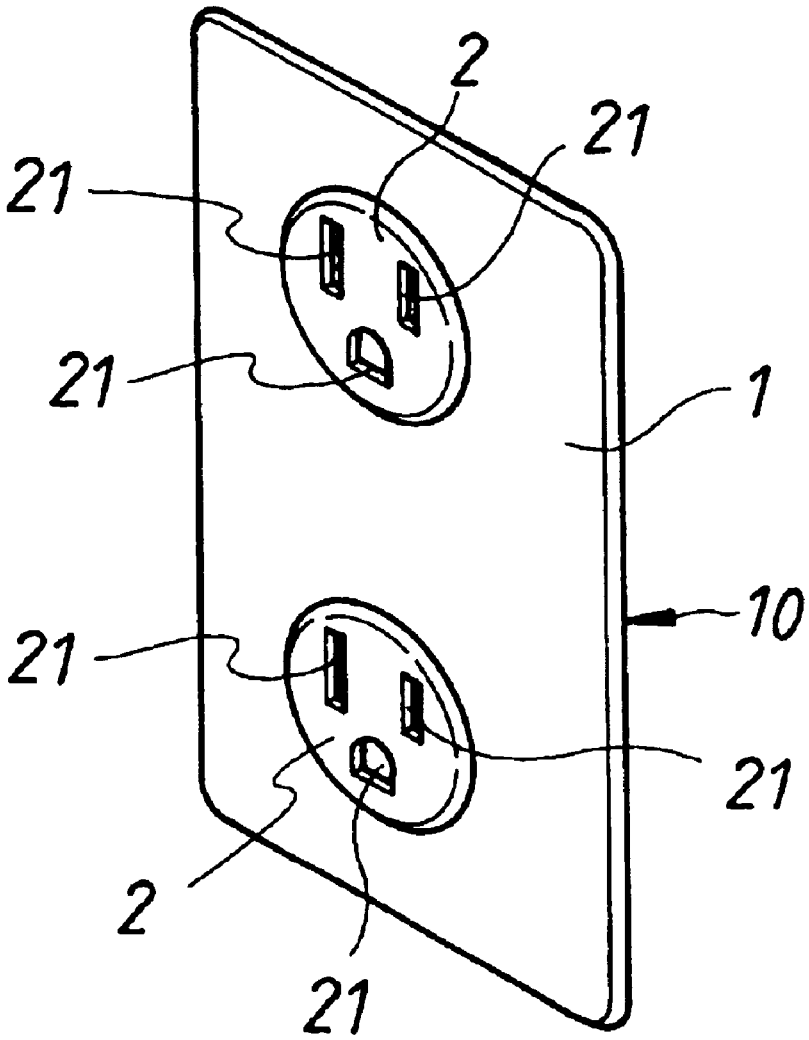
FIG. 1 is a schematic perspective view showing the present invention as applied to a wall receptacle.
Figure 2:
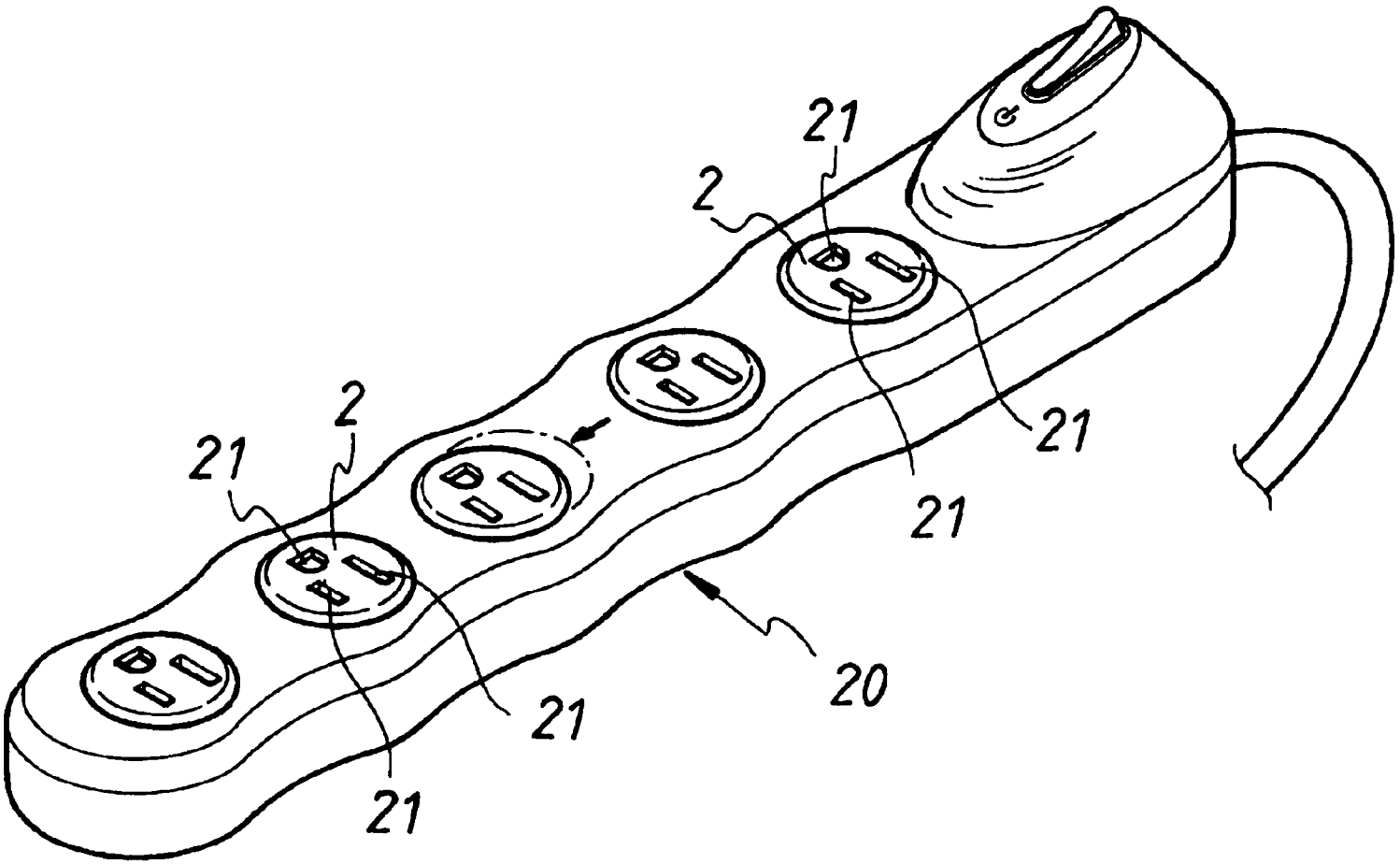
FIG. 2 is a schematic perspective view showing the present invention as applied to an extension line receptacle.
Figure 3:
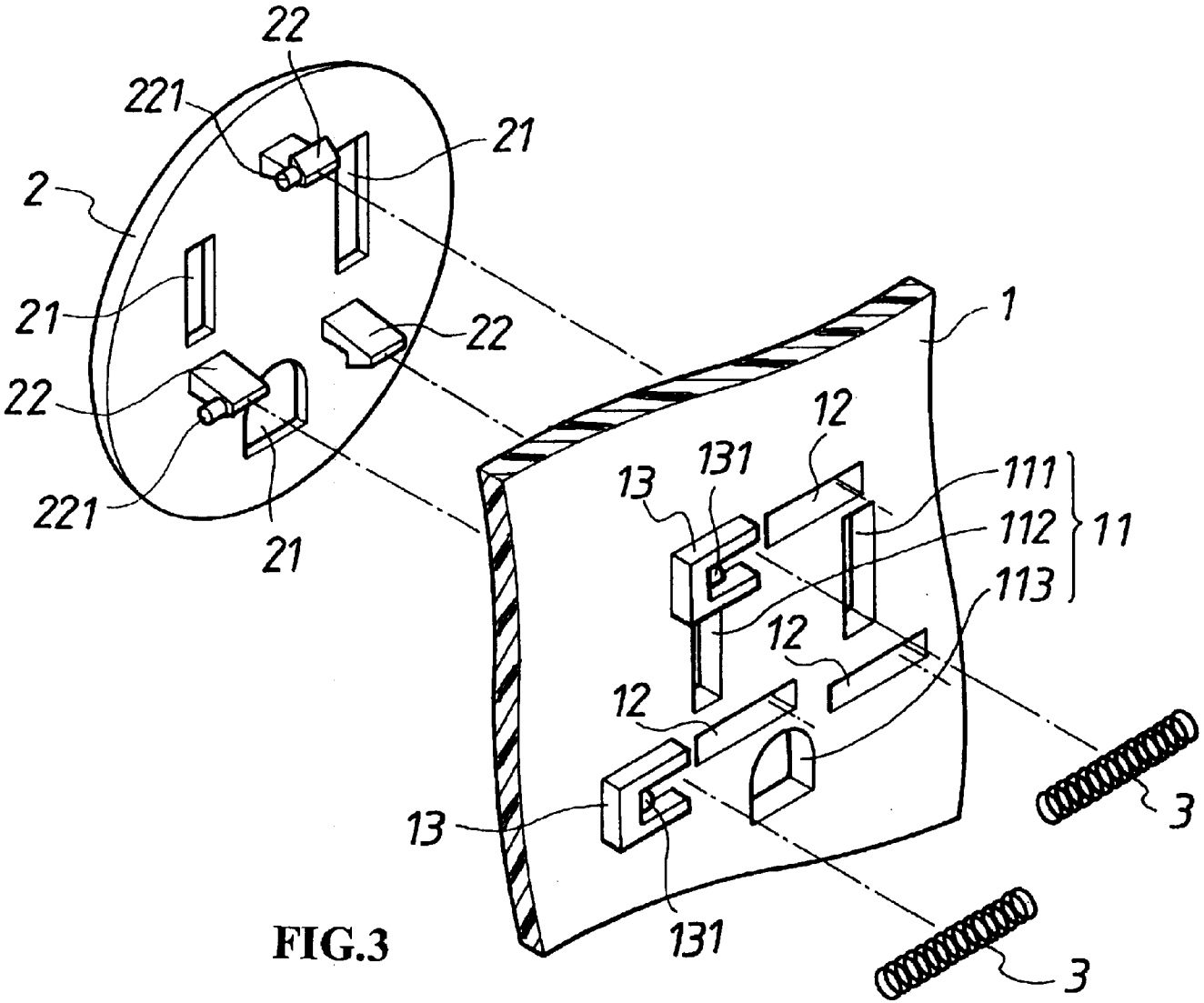
FIG. 3 is an exploded rear view of the present invention.
Figure 4:
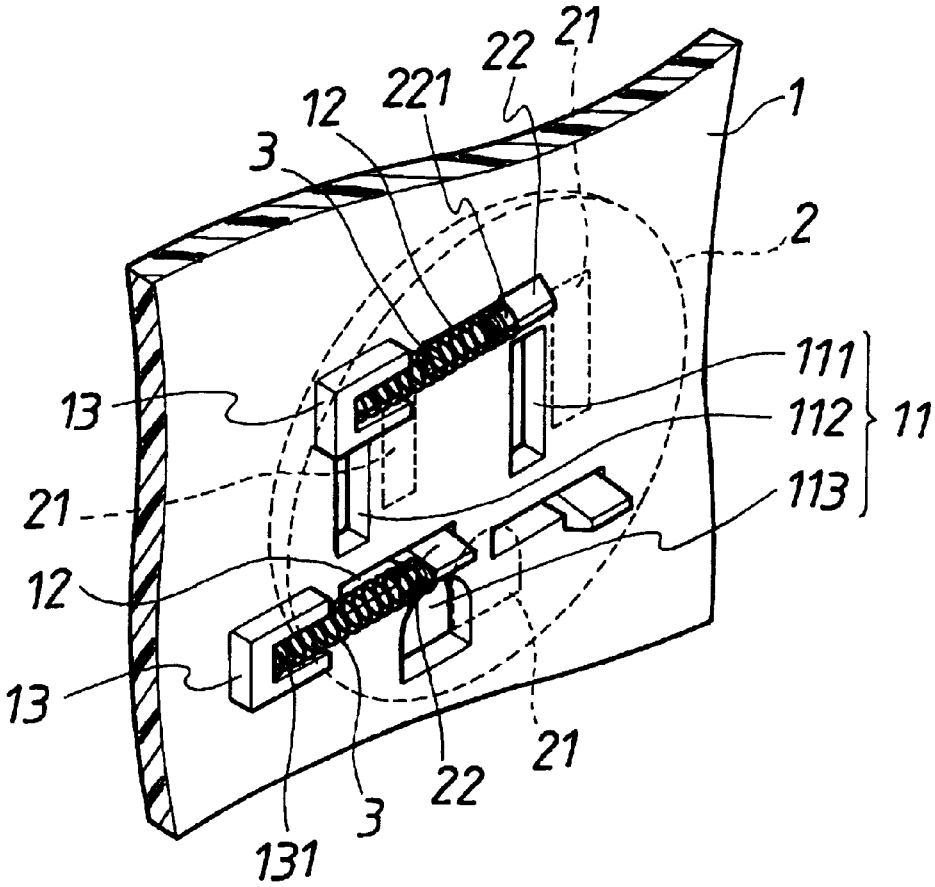
FIG. 4 is an assembled rear view of the present invention.

Referring to FIG. 4, the security device of a power receptacle of the present invention is illustrated. The security device of a power receptacle includes a slot cover 1, a protection cover 2, a plurality of elements 3. The slot cover 1 is installed on a wall receptacle 10 (referring to FIG. 1) or an extension line receptacle 20 (referring to FIG. 2). The shape of the wall receptacle 10 or the extension line receptacle 20 is not confined in the present invention. A surface of the slot cover 1 is installed with at least one power slot set 11. The power slot set 11 includes at least one live wire slot 111, a ground wire slot 112, and a grounding slot 113. In the present invention, on a surface of the power slot set 11 has at least two long recesses 12 penetrating to an interior of the receptacle (referring to FIG. 3, in FIG. 3, three slots are the illustrated). At least one recess 12 in an inner surface of the slot cover 1 is installed with a positioning block 13 at a lateral side thereof (referring to FIG. 3, in this embodiment, there are two positioning blocks 13 are illustrated). The positioning block 13 has a U shape and an interior thereof has a post 131.

The protection cover 2 (see FIG. 3) serves to isolate the openings of the live wire slot 111, ground wire slot 112 and grounding slot 113. The protection cover 2 can be in the shape of a round sheet. A surface thereof is formed with two or three holes 21 corresponding to the live wire slot 111, ground wire slot 112 and grounding slot 113. An inner surface thereof is formed with recesses 12 corresponding to hooking arms 22 corresponding to the recesses 12 of the protection cover 2. At least one hooking arm 22 is installed with the fixing block 221 at a lateral side thereof. The fixing block 221 may be formed as a post.

The elastic element 3 causes that the protection cover 2 to isolate the elements of the liver wire slot 111, ground wire slot 112, and grounding slot 113 in normal condition. The element 3 can be a helical compressible spring (referring to FIG. 3).

Figure 5:
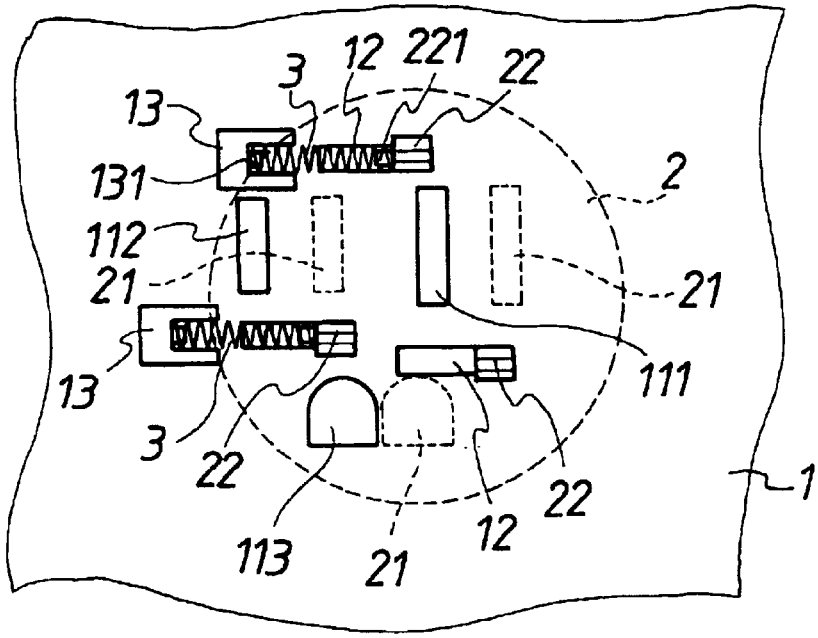
FIG. 5 is a rear view showing the protection cover of the present invention cover upon the receptacle.
Figure 6:
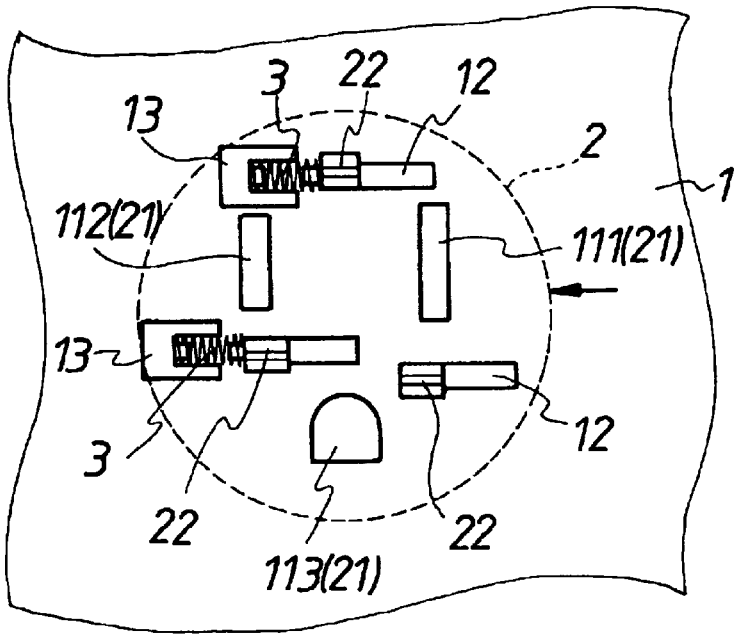
FIG. 6 is a rear view showing the protection cover moving linearly.
Figure 7:
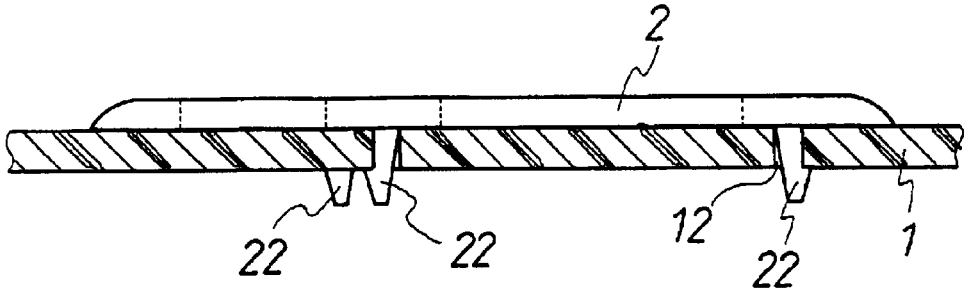
FIG. 7 is a schematic view showing the protection cover engaged to the slot cover according to the present invention.
Figure 9:
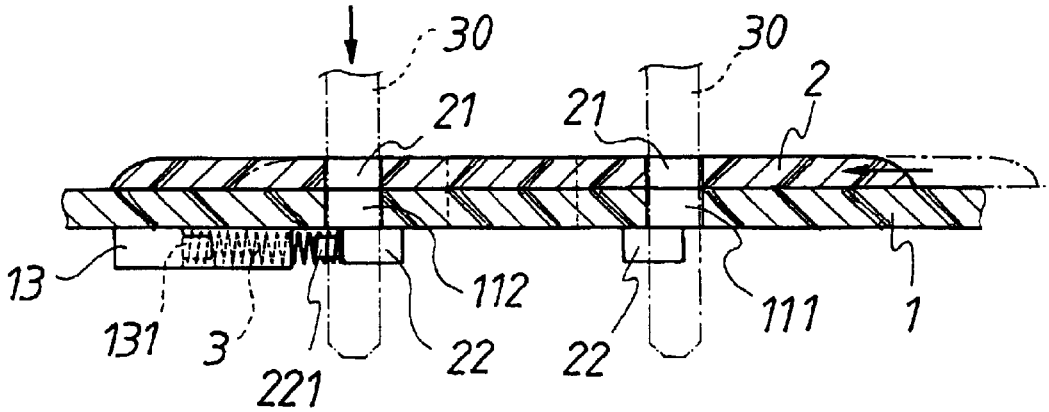
FIG. 9 is another schematic view showing the operation of the plug according to the present invention.

Thereby, referring to FIGS. 4, 5 and 7, the hooking arms 22 at the inner surface of the protection cover 2 are inserted into the recesses 12 of the slot cover 1. The slot cover 1 can not be guided by the recesses 12 to move linearly. The elastic elements 3 are installed between the positioning blocks 13 of the slot cover 1 and the fixing blocks 221 of the hooking arms 22. That is, two ends of the elastic elements 3 of helical compressible spring are engaged between the post 131 and the fixing block 221 so as to resist against the protection cover 2. Normally, the protection cover 2 will seal the live wire slot 111, ground wire slot 112, and grounding slot 113 (referring to FIGS. 5 and 7). After moving the protection cover 2, the via holes 21 of the protection cover 2 will align to the live wire slot 111, ground wire slot 112, and grounding slot 113 (referring to FIGS. 6 and 9). Thereby, the security device of a power receptacle of the present invention is formed.

In use of the security device of a power receptacle of the present invention, the protection cover 2 can be elastically resisted by the elastic elements 3 normally so that the live wire slot 111, ground wire slot 112 and grounding slot 113 are sealed. Thereby, undesired objects can not inserted into wall receptacle 10 or the extension line receptacle 20 with the slot cover 1 and thus dangerous accident can be avoided. Since normally, the protection cover 2 seals the live wire slot 111, ground wire slot 112 and grounding slot 113, dusts or insects can not move into the slots. The electric elements of the wall receptacle 10 or the extension line receptacle 20 can be protected so as to increase the lifetime of the wall receptacle 10 and the extension line receptacle 20.

Figure 8:
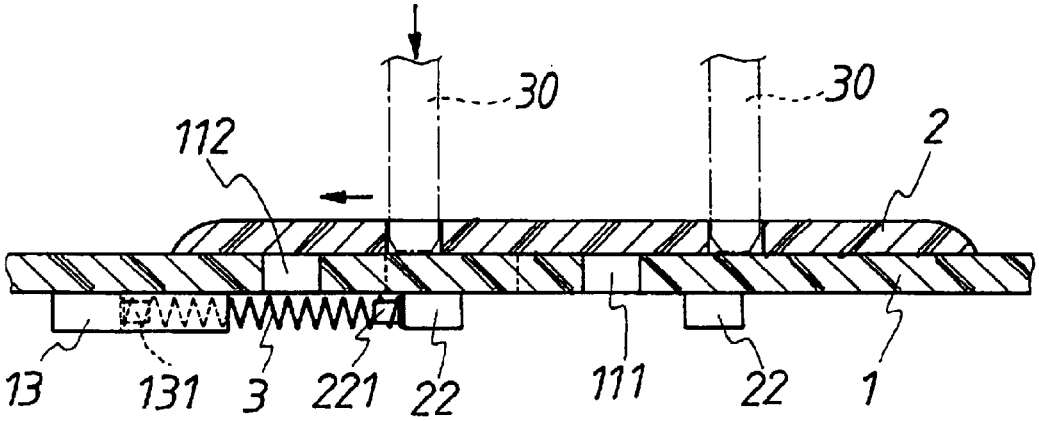
FIG. 8 is a schematic view showing the operation of the plug according to the present invention.

In the present invention, power can be conducted to a plug inserted in the receptacle (referring to FIG. 8). The plugs 30 are inserted into the holes 21 of the protection cover 2 and thus moves transversely so that the plugs 30 drive the protection cover 2 to move linearly. When the holes 21 aligns to the live wire slot 111, ground wire slot 112, and grounding slot 113, the plugs 30 can be further inserted into the interior of the live wire slot 111, ground wire slot 112 and grounding slot 113 (referring to FIG. 9) to electrically conduct to the electric elements in the wall receptacle 10 or the extension line receptacle 20 having the slot cover 1. However, when the user pull the plugs 30 out of the receptacle, the protection cover 2 is ejected by the elastic elements 3 to move to the original position to seal the live wire slot 111, ground wire slot 112, and grounding slot 113. Therefore, a safety effect is achieved.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A security device of a power receptacle comprising:

a slot cover being a cover installed on a receptacle;

a surface of the slot cover being installed with at least one power slot set;

a surface of the power slot set having at least two recesses penetrating to an interior of the receptacle;

at least one recess in an inner surface of the slot cover being installed with at least one positioning block at a lateral side thereof;

a protection cover configured for isolating contacts of the slot set of the slot cover;

a surface of the protective cover being formed with a plurality of holes, at least one of the holes corresponding to a slot of the slot set;

an inner surface of the protection cover being formed with the plurality of holes of the protective cover and a plurality of hooking arms; the plurality of holes of the protection cover corresponding to the plurality of hooking arms and corresponding to the recesses of the protection cover;

at least one of the hooking arms being installed with the fixing block at a lateral side thereof;

the hooking arms at the inner surface of the protection cover are inserted into the recesses of the slot cover;

the recesses of the slot cover can not be guided to move linearly;

a plurality of elastic elements are installed between each of the positioning blocks of the slot cover and a corresponding one of the fixing blocks of the hooking arms;

the elastic elements resist against the protection cover;

as a result, the protection cover will seal the slot set moreover, after moving the protection cover, the holes of the protection cover will align to the slot set of the slot cover.

2. The security device of a power receptacle as claimed in claim 1, wherein the receptacle is selected from the group consisting of a wall receptacle and an extension line receptacle.

3. The security device of a power receptacle as claimed in claim 1, wherein the slots of the slot cover include at least one live wire slot, one ground wire slot and one grounding slot.

4. The security device of a power receptacle as claimed in claim 1, wherein the slot cover has three recesses; at least two recesses have respective fixing blocks at lateral sides thereof.

5. The security device of a power receptacle as claimed in claim 1, wherein the positioning block of the slot cover has a U shape and an interior thereof has a post.

6. The security device of a power receptacle as claimed in claim 1, wherein the positioning block at the lateral side of the hook of the protection cover has a post.

7. The security device of a power receptacle as claimed in claim 1, wherein the elastic element is a helical compressible spring and two ends of the elastic element are positioned between the positioning block and the fixing block.

* * * * *